United States Patent [19]

Tieszen

[11] Patent Number: 5,023,762

[45] Date of Patent: Jun. 11, 1991

[54] CHANNEL WITH LOCKING TIP FOR DECORATIVE STRIP LIGHTING

[75] Inventor: Dwayne Tieszen, Ponder, Tex.

[73] Assignee: Vista Manufacturing, Inc., Elkhart, Ind.

[21] Appl. No.: 572,222

[22] Filed: Aug. 24, 1990

[51] Int. Cl.[5] ..... F21S 3/00

[52] U.S. Cl. ..... 362/223; 362/249; 362/368; 362/374

[58] Field of Search ..... 362/223, 225, 240, 249, 362/252, 368, 374, 375, 457, 217, 219

[56] References Cited

U.S. PATENT DOCUMENTS 4,376,966 3/1983 Tieszen ..... 362/267
4,413,311 11/1983 Orenstein ..... 362/252
4,819,136 4/1989 Ramsey ..... 362/375
4,903,179 2/1990 Lin ..... 362/252

*Primary Examiner*—Stephen F. Husar
*Assistant Examiner*—D. M. Cox
*Attorney, Agent, or Firm*—James D. Hall

[57] ABSTRACT

A channel and locking end tip for vinyl tube strip lighting. The tip includes a locking nib which is positioned within a channel opening for preventing the tip from shifting relative to the channel. To remove the tip, its outer end is pivoted upwardly such that the locking nib is spaced slightly above the channel bottom wall. A screw hole is provided through the tip body and channel for mounting. The vinyl tube light overlies the flange when carried by the channel. The mounting screw is external of the lighting bed such that the strip light may be fully assembled by the manufacturer and installed by the user with minimum effort.

3 Claims, 1 Drawing Sheet

CHANNEL WITH LOCKING TIP FOR DECORATIVE STRIP LIGHTING

FIELD OF THE INVENTION

This invention relates to a decorative strip lighting channel with locking end tips.

BACKGROUND OF THE INVENTION

Decorative lighting commonly referred to as strip lighting has gained popularity in recent years for use as lighting accents to vehicles, such as boats, trucks and vans. Strip lighting has also gained wide acceptance as decorative lighting for use in restaurants, movie theaters and other public places. One type of such strip lighting is described in U.S. Pat. No. 4,376,966. As discussed in the '966 patent, the strip lighting tube may be housed within a rigid channel which has a pair of inclined side walls and a bottom wall. It is common for this channel to be terminated by decorative end tips. Each end tip includes a flange which frictionally engages the channel side walls. The tip is connected to the channel by a screw passing through the tip flange and channel bottom wall and seating within a supporting structure to attach the channel and tip to the structure. The strip lighting tube is press fitted within the channel and overlies the screw.

A problem exists with current channel and tip constructions in that to attach the tip and channel to a supporting structure in the manner described, the flexible tube must be removed from the channel as the connecting screw is turned through the tip into the supporting structures. After the tip and channel are attached to the supporting structure, the flexible light tube is then press fitted into the channel while the electrical wires are fed through an opening in the channel bottom wall. The installation of removal of the prior art strip lighting channel and strip light as described is an awkward process.

Further, the tip is only locked into position with the channel when a screw or rivet connects the channel and tip to a supporting structure. Therefore, when the vinyl tube which is cut over-length to allow for shrinkage is installed by the manufacturer for packaging, the tip may be pushed out of the channel into the packaging. This makes assembly, commerical packaging and display of the channeled strip light difficult and expensive for the manufacturer.

A second type of prior art strip lighting tip and channel is formed from plastic and constructed so that as the tip is inserted into the channel a nib at the underside of the tip frictionally engages the bottom wall of the channel. The channel is attached to a supporting structure by double sided adhesive tape carried by the channel. This type of strip lighting channel suffers from the same problem of tip displacement by the tube lighting. Further, the insertion of the flange within the plastic channel may cause the walls of the channels to bulge outwardly about the flange. Such a bulging channel is aesthetically unappealing.

SUMMARY OF THE INVENTION

The strip lighting channel and end tip of this invention eliminates the problems described above by including an opening in the channel bottom wall for locking engagement with a nib extending from the tip flange. The tip also includes one or more protrusions which in contacting the channel bottom wall serve as a pivot to facilitate removal of the tip from the channel when desired. Further the screw hole through the tip and channel is external of the channel tube lighting bed and therefore not overlaid by the tube lighting.

Therefore the interlocking channel and tip of this invention permits the manufacturer to fully assemble the channeled tube lighting prior to packaging as the tip is locked against lateral movement. Installation and removal of the channel is made easier for the user by locating the openings for the mounting screws external of the tube lighting bed formed by the channel permitting installation and removal with the lighting tube channeled.

Accordingly, it is an object of this invention to provide a novel tube lighting channel and tip.

Another object of this invention is to provide a tube lighting channel and tip that can be fully assembled by the manufacturer prior to packaging.

Other objects of this invention will become apparent upon a reading of the following description taken with the accompanying drawings.

DESCRIPTION OF THE PREFERRED EMBODIMENT

The preferred embodiment herein disclosed is not intended to be exhaustive or to limit the application to the precise form disclosed. Rather, it is chosen and described so that others skilled in the art might utilize its teachings.

Figure 1:
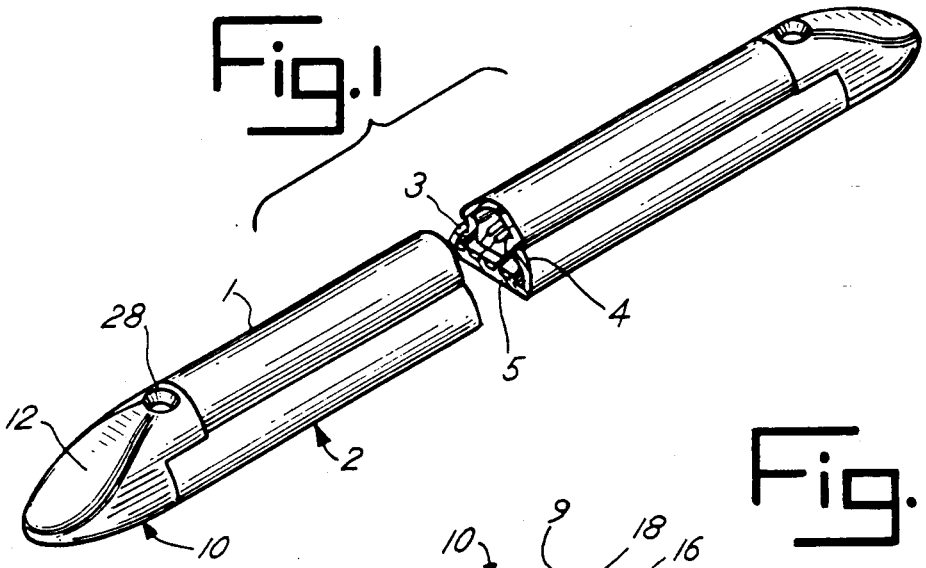
FIG. 1 is a perspective view of the channel and tip of this invention carrying a tube light and shown in broken form for illustrative purposes.
Figure 2:
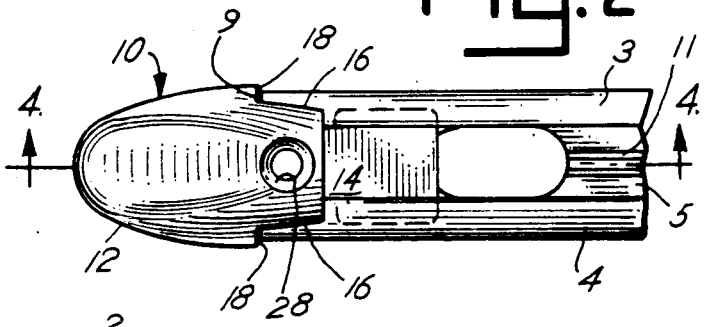
FIG. 2 is a top view of one end of the channel of this invention with a tip attached.
Figure 3:
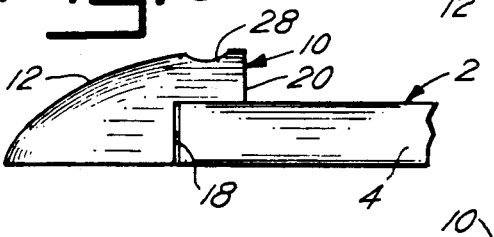
FIG. 3 is a side elevational view of FIG. 2.
Figure 4:
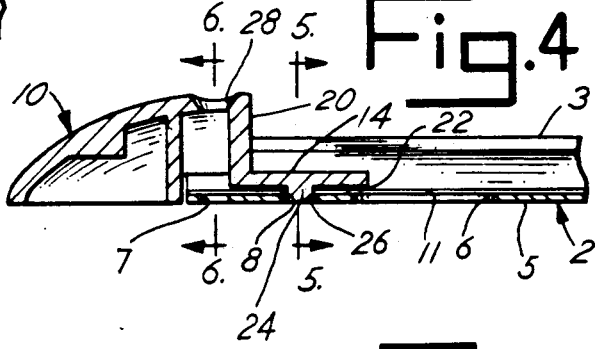
FIG. 4 is a fragmented sectional view taken along line 4—4 of FIG. 2.
Figure 5:
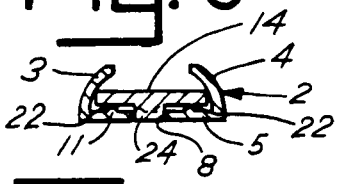
FIG. 5 is a cross sectional view taken along line 5—5 of FIG. 4.
Figure 6:
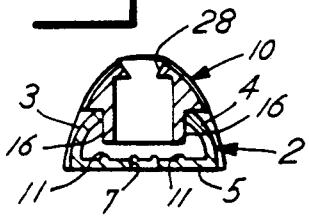
FIG. 6 is a cross sectional view taken along line 6—6 of FIG. 4.

Referring now to the drawings, channel 2 with interlocking tip 10 is illustrated. A vinyl strip light tube 1 is carried in channel 2 (See FIG. 1). Channel 2 includes converging sides 3 and 4 joined by a flat bottom wall 5. An enlarged opening 6 is formed through wall 5 adjacent each end 9 of the channel (only one end fully shown). A plurality of spaced ribs 11 extend longitudinally along bottom wall 5 of the channel. As thus far described channel 2 is substantially similar to the channel disclosed in U.S. Pat. No. 4,376,966 incorporated herein by reference. The channel of this invention further includes a pair of longitudinally aligned openings 7, 8 formed along the center-line of and through bottom wall 5 between each opening 6 and end 9 of channel 2.

Tip 10 includes as integral components a body 12 having a flange 14 projecting from one end thereof for slidable receipt within an end 9 of channel 2 when seated against bottom wall 5. Indentations 16 are formed on opposite sides of the tip body 12 for slidable engagement with sides 3 and 4 of channel 2. Indentations 16 include shoulders 18 which abut against the channel end 9 to limit the insertion of tip 10 into channel 2. Body 12 of tip 10 also includes an abutment 20 that extends outwardly from flange 14 and between indentations 16 as illustrated. A pair of spaced protrusions or locator tabs 22 extend inwardly from flange 14 at its outermost edge for contact with channel bottom wall 5 preferably at ribs 11 as illustrated. A locking nib 24 extends outwardly from flange 14 and includes a beveled surface 26 facing tabs 22. Nib 24 is accommodated within opening 8 of bottom wall 5 when shoulders 18 of the tip abut end 9 of the channel. Beveled surface 26 serves to cam and wedge the nib 24 into the channel. The accommodation of locking nib 24 within opening 8 prevents tip 10 from shifting longitudinally relative to channel 2. A beveled opening 28 is formed in tip body 12 which aligns with opening 7 formed in bottom wall 5 when the tip is secured within the channel. A common screw (not shown) will extend through aligned openings 28 and 7 to secure the channel and tip to a supporting surface. When channel 12 and tip 10 are connected to a supporting surface, opening 6 would be aligned with an opening in the supporting structure to accommodate passage of electrical leads from the light tube 1 for connection to a voltage source.

Figure 7:
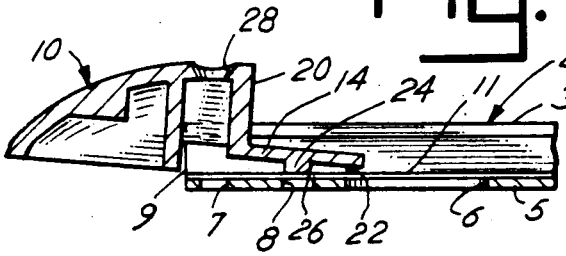
FIG. 7 is a fragmented sectional view of FIG. 4 with the end tip pivoted for removal.

To remove tip 10 from channel 2, tip 10 is pivoted as shown in FIG. 7. With tip 10 pivoted about locator tabs 22 as illustrated, locking nib 24 clears channel opening 7 to allow the tip to be pulled from the channel. Beveled rearward surface 26 on nib 24 provides clearance to allow the tip to be pivoted for removal.

It should be understood that the invention is not to be limited to the above details but may be modified within the scope of the appended claims.

I claim:

1. In combination, an elongated channel a locking end tip and a strip light tube, said channel having an end and including a pair of side walls connected by an integral bottom wall, said bottom wall including an opening therethrough adjacent said channel end, said tip including a body and an integral flange extending from said body, said tip being inserted into said channel with said flange extending between said channel side walls adjacent said channel end, a nib extending from said tip flange in the direction of said channel bottom wall, said nib being positioned within said channel opening to prevent longitudinal shifting of said tip relative to said channel, said strip light tube being retained within said channel by said side walls, said strip light tube having an end, said strip light tube overlying said tip flange with said strip light tube end adjacent the body of the tip.

2. The combination of claim 1 wherein said tip body includes an opening therethrough, said channel bottom wall including a second opening adjacent said channel end, said tip opening and said channel second opening being in alignment for accommodating a fastening device when said nib is positioned within the first mentioned channel opening.

3. The combination of claim 1 wherein sid tip further includes a protrusion extending from said flange toward said channel bottom wall with said nib positioned between said tip body and said protrusion, said tip being pivotal on said protrusion relative to said channel to support said nib above said bottom wall for removal of said tip from said channel.

* * * * *